US008944792B2

(12) United States Patent
McGuffey

(10) Patent No.: US 8,944,792 B2
(45) Date of Patent: Feb. 3, 2015

(54) METERING GEAR PUMP OR SEGMENT, AND METERING GEAR PUMP ASSEMBLY COMPRISING A PLURALITY OF METERING GEAR PUMPS OR SEGMENTS

(75) Inventor: Grant McGuffey, Springfield, TN (US)

(73) Assignee: Illinois Tool Works Inc., Glenview, IL (US)

( * ) Notice: Subject to any disclaimer, the term of this patent is extended or adjusted under 35 U.S.C. 154(b) by 703 days.

(21) Appl. No.: 12/801,027

(22) Filed: May 18, 2010

(65) Prior Publication Data

US 2011/0286872 A1 Nov. 24, 2011

(51) Int. Cl.

| | |
|---|---|
| ***F01C 1/00*** | (2006.01) |
| ***F04C 2/14*** | (2006.01) |
| ***F04C 11/00*** | (2006.01) |

(52) U.S. Cl.

CPC ..... *F04C 2/14* (2013.01); *F04C 11/001* (2013.01); *F04C 2220/24* (2013.01); *F04C 2230/60* (2013.01); *F04C 2240/70* (2013.01)

USPC ..... 418/200; 418/144; 418/102; 418/175

(58) Field of Classification Search

CPC .... F04C 2/14; F04C 2230/60; F04C 2240/70; B29C 47/043; B29C 47/367; B29C 47/1063

USPC ..... 222/255, 274, 333, 410; 418/75, 102, 418/131, 132, 144, 175, 191, 196, 206.1, 418/206.6–206.8, 199, 200

See application file for complete search history.

(56) References Cited

U.S. PATENT DOCUMENTS

| | | | | | |
|---|---|---|---|---|---|
| 2,362,922 | A | * | 11/1944 | Palm | 417/201 |
| 2,533,320 | A | * | 12/1950 | Hull et al. | 418/183 |
| 3,179,382 | A | * | 4/1965 | Knedlik | 366/272 |
| 3,266,430 | A | * | 8/1966 | Mylo | 418/10 |
| 3,601,514 | A | * | 8/1971 | Afner | 418/68 |
| 3,869,224 | A | * | 3/1975 | Brinkman | 417/383 |
| 4,195,480 | A | * | 4/1980 | Shelby et al. | 60/486 |
| 5,637,331 | A | * | 6/1997 | Lenk et al. | 425/206 |
| 5,755,566 | A | * | 5/1998 | Marsillo et al. | 418/200 |
| 5,829,647 | A | * | 11/1998 | Miller | 222/274 |
| 6,171,089 | B1 | * | 1/2001 | Oehman, Jr. | 418/75 |
| 6,296,463 | B1 | * | 10/2001 | Allen | 425/7 |
| 6,305,831 | B1 | * | 10/2001 | Gathmann et al. | 366/79 |
| 6,422,428 | B1 | * | 7/2002 | Allen et al. | 222/318 |
| 6,688,498 | B1 | * | 2/2004 | McGuffey | 222/333 |
| 2007/0248480 | A1 | * | 10/2007 | Mayer et al. | 418/206.1 |

FOREIGN PATENT DOCUMENTS

| | | | | | |
|---|---|---|---|---|---|
| GB | 2086481 | A | * | 5/1982 | F04C 2/14 |

* cited by examiner

*Primary Examiner* — Thai Ba Trieu

*Assistant Examiner* — Jason T Newton

(74) *Attorney, Agent, or Firm* — Law Offices of Steven W. Weinrieb

(57) ABSTRACT

A metering pump or segment, and a metering pump assembly comprising a plurality of the metering pumps or segments, are disclosed. The drive shaft assembly for driving the pump gears of each metering pump or segment is coaxially aligned with the longitudinal axis of the pump or segment, as is the fluid inlet. The single drive shaft assembly is utilized to drive all of the metering pumps or segments comprising the metering pump assembly, and the different metering pumps or segments are fluidically connected together by means of a common fluid passageway. In addition, the different metering pumps or segments can be interchanged or exchanged so as to permit different metered fluid output volumes to be outputted at different predetermined locations, and the dispensing volumes can also be added together.

23 Claims, 3 Drawing Sheets

METERING GEAR PUMP OR SEGMENT, AND METERING GEAR PUMP ASSEMBLY COMPRISING A PLURALITY OF METERING GEAR PUMPS OR SEGMENTS

FIELD OF THE INVENTION

The present invention relates generally to metering pumps, and more particularly to a new and improved metering pump or segment, and to a new and improved metering pump assembly comprising a plurality of the metering pumps or segments, wherein in connection with the individual metering pumps or segments, the drive shaft assembly for driving the pump gears of each metering pump or segment is coaxially aligned with the longitudinal axis of the pump or segment, as is the fluid inlet supply path, whereby only three gears are required to comprise each metering pump or segment, and in connection with the metering pump assembly comprising the plurality of metering pumps or segments, not only is the drive shaft assembly and fluid inlet supply path coaxial with the longitudinal axis of the metering pump assembly, but the single drive shaft assembly is utilized to drive all of the metering pumps or segments comprising the metering pump assembly, and the different metering pumps or segments are fluidically connected together by means of a common fluid passageway. In addition, the different metering pumps or segments comprising the metering assembly can be interchanged with respect to each other so as to permit different metered flow output volumes to be outputted at different predetermined locations. Furthermore, different metering pumps or segments, having different output ratings or values, can be exchanged for existing metering pumps or segments within the metering pump assembly and thereby disposed at the predetermined positions within the metering pump assembly so as to achieve the different metered flow output volumes at the predetermined positions. Lastly, different metering pumps or segments can be disposed or arranged such that their fluid output flows will be located at substantially the same predetermined positions within the metering pump assembly whereby the metered fluid output volumes from the various metering pumps or segments can effectively be added together so as to achieve additionally desired metered fluid output volumes which are different from that achieved from any single one metering pump or segment.

BACKGROUND OF THE INVENTION

In some fluid delivery systems, such as, for example, those systems delivering hot melt adhesive or other thermoplastic materials, it is necessary to supply various output devices with predetermined volumes of the fluids. Metering pumps are utilized to in fact provide the fluids in metered amounts as required or dictated by means of their desired or specific end use. The metering pumps are driven by motor drive assemblies which operate the respective pumps at predetermined speeds in order that the metering pumps output the predetermined volumes of the fluid required for the particular use or by the particular output device. However, it is sometimes desired to achieve different metered fluid output volumes in order to provide different metered fluid output volumes to different output devices or for different end uses.

One known type of metering pump assembly is that disclosed within U.S. Pat. No. 6,688,498 which is entitled HOT MELT ADHESIVE SUPPLY SYSTEM WITH INDEPENDENT GEAR PUMP ASSEMBLIES and which issued to McGuffey on Feb. 10, 2004. While this metering pump system is quite satisfactory, it is noted that the arrangement does require the supply of the hot melt adhesive into a manifold and the subsequent supply or transmission of the fluid to the metering pump gears by means of a gearing system which comprises four gears. Another known type of metering pump assembly is that disclosed within U.S. Pat. No. 6,422,428 which is entitled SEGMENTED APPLICATOR FOR HOT MELT ADHESIVES OR OTHER THERMOPLASTIC MATERIALS and which issued to Allen et al. on Jul. 23, 2002. While this metering pump system is also satisfactory, it is noted that the drive shaft assembly and the fluid input into the metering pump assembly are not coaxially aligned with the longitudinal axis of the metering pump assembly. In addition, the different metering pumps or segments cannot be disposed or arranged such that their fluid output flows will be located at substantially the same predetermined positions within the metering pump assembly whereby the metered fluid output volumes from the various metering pumps or segments can effectively be added together so as to achieve additionally desired metered fluid output volumes which are different from that achieved from any single one metering pump or segment.

A need therefore exists for a new and improved metering pump or segment which is relatively simplified in structure and yet, when incorporated within a metering pump assembly, the individual metering pumps or segments can be driven by means of a single drive shaft assembly, the individual metering pump or segments can be fluidically connected together by means of a common fluid passageway, the individual metering pumps or segments can be interchanged with each other so as to provide different metered fluid output volumes at different predetermined locations, the metering pumps or segments incorporated within the metering pump assembly can be exchanged for other metering pumps or segments so as to provide still yet different metered fluid output volumes, and the metering pumps or segments incorporated within the metering pump assembly can be predeterminedly positioned with respect to each other such that the metered fluid output volumes from the various metering pumps or segments can effectively be added together so as to achieve additional different metered fluid output volumes.

SUMMARY OF THE INVENTION

The foregoing and other objectives are achieved in accordance with the teachings and principles of the present invention through the provision of a new and improved metering pump or segment, and to a new and improved metering pump assembly comprising a plurality of the metering pumps or segments, wherein in connection with the individual metering pumps or segments, the drive shaft assembly for driving the pump gears of each metering pump or segment is coaxially aligned with the longitudinal axis of the pump or segment, as is the fluid inlet supply path, whereby only three gears are required to comprise each metering pump or segment. In connection with the metering pump assembly comprising the plurality of metering pumps or segments, not only is the drive shaft assembly and fluid inlet supply path coaxial with the longitudinal axis of the metering pump assembly, but the single drive shaft assembly is utilized to drive all of the metering pumps or segments comprising the metering pump assembly, and the different metering pumps or segments are fluidically connected together by means of a common fluid passageway.

In addition, the different metering pumps or segments comprising the metering assembly can be interchanged with respect to each other so as to permit different metered fluid output volumes to be outputted at different predetermined locations. Furthermore, different metering pumps or segments, having different output ratings or values, can be exchanged for existing metering pumps or segments within the metering pump assembly and thereby disposed at the predetermined positions within the metering pump assembly so as to achieve the different metered flow output volumes at the predetermined positions. Lastly, different metering pumps or segments can be disposed or arranged such that their fluid output flows will be located at substantially the same predetermined positions within the metering pump assembly whereby the metered fluid output volumes from the various metering pumps or segments can effectively be added together so as to achieve additionally desired metered fluid output volumes which are different from that achieved from any single one metering pump or segment.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
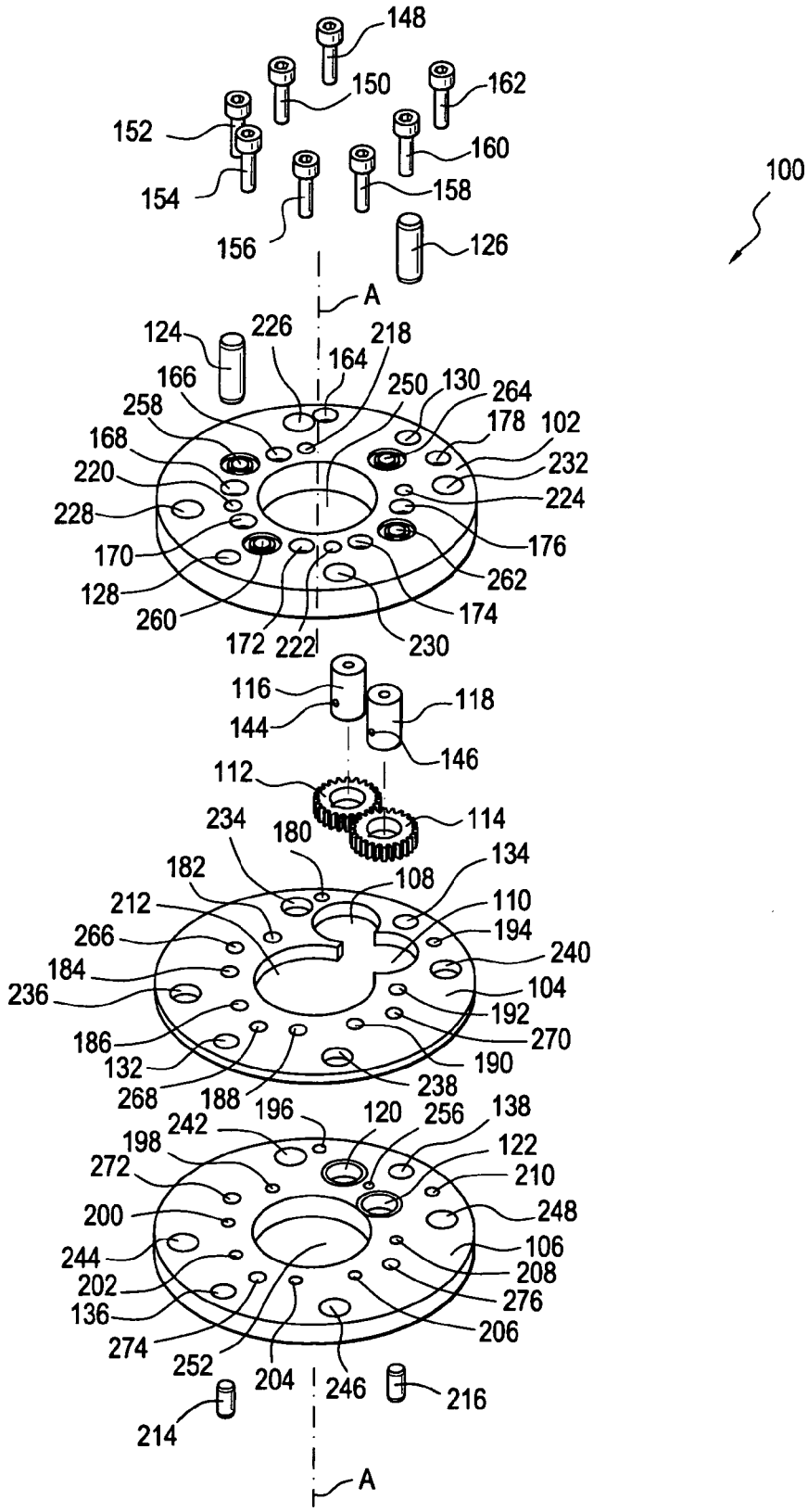
FIG. 1 is an exploded view of a new and improved metering pump or segment as constructed in accordance with the principles and teachings of the present invention and showing the operative parts thereof.

Referring now to the drawings, and more particularly to FIG. 1 thereof, a new and improved metering gear pump or segment is disclosed and is generally indicated by the reference character 100. More particularly, it is seen that the new and improved metering gear pump or segment 100 comprises an upper or top cap plate 102, an intermediate or central pump plate 104, and a lower or bottom base plate 106. In connection with the intermediate or central pump plate 104, it is seen that the intermediate or central pump plate 104 is provided with a pair of pump gear cavities 108,110 for respectively housing or containing a pair of pump gears 112, 114, and it is to be noted that the axial length, height, or thickness of each one of the pump gears 112,114, as considered in the direction effectively taken along the longitudinal axis A of the gear pump or segment 100, is substantially equal to the axial length, height, or thickness of the intermediate or central pump plate 104 such that the upper extents of the pump gears 112,114 do not project above the upper or top surface portion of the intermediate or central pump plate 104, and in a similar manner, the lower extents of the pump gears 112,114 do not project beneath the lower or undersurface portion of the intermediate or central pump plate 104. It is also to be noted that the diametrical extents of each one of the pump gears 112,114 is substantially the same as the diametrical extents of the respective pump gear cavities 108,110 such that the outer peripheral edge or surface portions of the pump gears 112,114 are disposed in close proximity to the internal peripheral edge or surface portions of the pump gear cavities 108,110 so as to effectively define sealing interfaces therebetween whereby the liquids being pumped are effectively prevented from passing around the gear perimeters.

In order to maintain the pair of pump gears 112,114 centered within their respective pump gear cavities 108,110, a pair of idler pins 116,118 are disposed within the central openings of the pump gears 112,114 whereby the lower end portions of the idler pins 116,118 are adapted to be disposed within a pair of bushing cavities 120,122 respectively formed within the upper surface portion of the lower or bottom base plate 106, while the upper end portions of the idler pins 116,118 are similarly adapted to be disposed within a pair of bushing cavities, not shown or visible, respectively formed within the undersurface portion of the upper or top cap plate 102. In addition, a pair of diametrically opposed dowel pins 124,126 are adapted to be inserted through and disposed within the upper or top cap plate 102, the intermediate or central pump plate 104, and the lower or bottom base plate 106 so as to effectively define and maintain the coaxial alignment of the pump gear cavities 108,110, the pump gears 112, 114, the bushing cavities 120,122 defined within the lower or bottom base plate 106, and the bushing cavities, not shown or visible, defined within the upper or top cap plate 102. A pair of through-bores 128,130 are therefore accordingly provided within the upper or top cap plate 102 so as to permit the dowel pins 124,126 to pass therethrough, and a pair of through-bores 132,134 are similarly provided within the intermediate or central pump plate 104 so as to likewise pass therethrough, while a pair of through bores 136,138 are also provided within the lower or bottom base plate 106 so as to permit the lower end portions of the dowel pins 124,126 to be seated therein. Due to manufacturing tolerances defined between the dowel pins 124,126 and the through-bores 136,138, the dowel pins 124,126 will be retained within the through-bores 136, 138 and will not fall downwardly through or out from the through-bores.

In this manner, when the metering pump or segment 100, comprising the upper or top cap plate 102, the intermediate or central pump plate 104, and the lower or bottom base plate 106 are assembled together, the pump gears 112,114 will be able to rotate freely within the confines of their pump gear cavities 108,110. In connection with the idler pins 116,118, it is additionally noted that each one of the idler pins 116, 118 is provided with an axially extending through-bore 140, 142. Due to the close tolerances defined between the external peripheral surface portions of each one of the idler pins 116, 118 and the inner peripheral surface portions of the bushing cavities 120,122 defined within the lower or bottom base plate 106, as well as the close tolerances defined between the external peripheral surface portions of each one of the idler pins 116,118 and the inner peripheral surface portions of the bushing cavities, not shown or visible, defined within the upper or top cap plate 102, it has been found that the provision of such axially extending through-bores 140,142 within the idler pins 116,118 effectively relieves any "suction" or "vacuum" effect that may develop between the idler pins 116,118 and the bushing cavities as a result of the aforenoted close tolerances. In this manner, it has been found still further that the idler pins 116,118 are able to be more easily inserted and withdrawn from the bushing cavities. Still yet further, it is also seen that outer peripheral side wall portions of each one of the idler pins 116,118 are provided with small holes or bores 144,146, and similar bores or holes, not shown or visible, are likewise provided upon internal peripheral side wall portions of the pump gears 112,114. Small balls or bearing members are adapted to have hemispherical portions thereof disposed within the respective bores or holes of both the pump gears 112,114 and the idler pins 116,118, and in this manner, both of the pair of idler pins 116,118 will rotate with their respective pump gears 112,114 as the pump gears 112, 114 are rotatably driven by a suitable drive gear when metering of the fluid is being outputted as will be more fully disclosed and described hereinafter.

With continued reference being made to FIG. 1, and in connection with the assembly of the upper or top cap plate 102, the intermediate or central pump plate 104, and the lower or bottom base plate 106 together so as to in fact form the metering gear pump or segment 100, it is noted that a plurality of cap screws, such as, for example, eight (8) cap screws 148,150,152,154,156,158,160,162, are provided so as to in fact secure the upper or top cap plate 102, the intermediate or central pump plate 104, and the lower or bottom base plate 106 together in a clamping manner such that the intermediate or central pump plate 104 is effectively fixedly secured or sandwiched between the upper or top cap plate 102 and the lower or bottom base plate 106. More particularly, it is seen that each one of the cap screws 148,150,152,154,156, 158, 160,162 passes through through-bores 164,166,168,170,172, 174,176,178 defined within the upper or top cap plate 102, and similarly passes through through-bores 180,182,184,186, 188,190,192,194 defined within the intermediate or central pump plate 104 such that the lower end portions of the cap screws 148,150,152,154,156,158,160,162 can be respectively threadedly engaged within internally threaded through bores 196,198,200,202,204,206,208,210 defined within the lower or bottom base plate 106.

It is noted that the through-bores 164,166,168,170, 172, 174,176,178, defined within the upper or top cap plate 102 have diametrical extents which are somewhat larger than the diametrical extents of the through-bores 180,182,184,186, 188,190,192,194 defined within the intermediate or central pump plate 104 or the internally threaded blind bores 196, 198,200,202,204,206,208,210 defined within the lower or bottom base plate 106, so as to permit the through-bores 164, 166,168,170,172,174,176,178 defined within the upper or top cap plate 102 to accommodate the relatively large diameter head portions of the cap screws 148,150,152,154,156, 158, 160,162, whereas the through-bores 180,182,184,186, 188,190, 192,194, defined within the intermediate or central pump plate 104, and the internally threaded blind bores 196, 198, 200,202,204, 206,208,210, defined within the lower or bottom base plate 106, need only accommodate the relatively small diameter shank portions of the cap screws 148,150,152, 154, 156,158,160,162. It is also to be noted that the through-bores 164,166,168,170,172,174,176,178 defined within the upper or top cap plate 102 are counterbored so as to define ledge portions, not shown or visible, within the upper or top cap plate 102 upon which the relatively large head portions of the cap screws 148,150,152,154,156,158,160, 162 can be seated so as to effectively apply a downward clamping force onto the intermediate or central pump plate 104 and the lower or bottom plate 106 when the lower end threaded portions of the cap screws 148,150,152,154,156,158, 160,162 are threadedly engaged within the internally threaded blind bores 196, 198,200,202,204,206,208,210 defined within the lower or bottom base plate 106.

Still further, it is noted that the plurality of cap screws 148,150,152,154,156,158,160,162 are arranged in a predetermined, substantially horse-shoe shaped array surrounding the pump gear cavities 108,110 as well as a central through-bore or cavity 212 which is adapted to accommodate a drive gear shaft assembly which will be more fully disclosed and described hereinafter. This particular substantially horse-shoe shaped array of the plurality of cap screws 148, 150,152, 154,156,158,160,162 is provided so as to effectively ensure that those regions of the undersurface face portion of the intermediate or central pump plate 104, which surround the pump gear cavities 108,110 and the central cavity 212, will be disposed in a substantially tight sealing mode with respect to corresponding regions of the upper surface portion of the lower or bottom base plate 106, and similarly, the aforenoted arrangement of the 148,150,152,154,156,158,160,162 will likewise ensure that those regions of the upper surface face portion of the intermediate or central pump plate 104 which, again, surround the pump gear cavities 108,110 and the central cavity 212, will be disposed in a substantially tight sealing mode with respect to corresponding regions of the undersurface portion of the upper or top cap plate 102, so as to optimally ensure no leakage of the pumped fluid.

Figure 2:
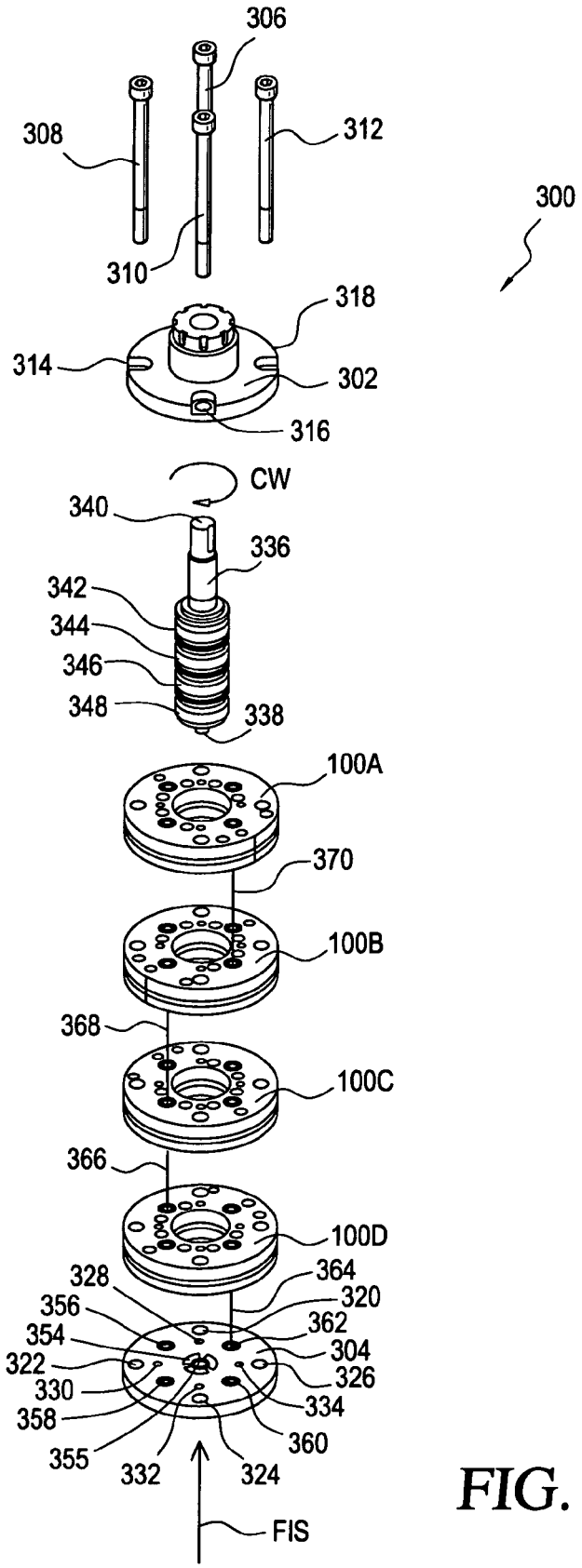
FIG. 2 is an exploded view of a new and improved metering pump assembly, comprising a plurality of the metering pumps or segments disclosed within FIG. 1, as constructed in accordance with the principles and teachings of the present invention and showing the operative parts thereof.

With reference continuing to be made to FIG. 1, as well as to FIG. 2, another important feature characteristic of the metering gear pump or segment 100 as disclosed within FIG. 1 resides in the provision of a pair of dowel pins 214,216 which are adapted to be fixedly mounted within suitable blind bores, not shown or visible, which are provided within undersurface portions of the lower or bottom base plate 106 so as to project or extend axially downwardly therefrom. Correspondingly, it is additionally seen that upper surface portions of the upper or top cap plate 102 are provided with a plurality of blind bores, such as, for example, four (4) blind bores 218,220,222,224, which are circumferentially spaced in an equiangular manner about the longitudinal axis A of the metering pump or segment 100 so as to be spaced in a quadrant array at 90° intervals with respect to each other. Accordingly, when a plurality of metering pumps or segments 100A, 100B,100C,100D are effectively assembled together in a serially stacked array, one atop another, as disclosed within FIGS. 2 and 3, so as to form a metering pump assembly, generally indicated by the reference character 300, upper ones of the metering pumps or segments 100A,100B, 100C, 100D may be fixedly nested at predetermined angular positions with respect to lower adjacent ones of the metering pumps or segments 100A,100B,100C,100D as a result of the dowel pins 214,216, projecting downwardly from a particular upper one of the metering pumps or segments 100A,100B, 100C, 100D, being seated within a particular pair of the blind bores 218,220,222,224 defined within the upper surface portions of an adjacent lower one of the metering pumps or segments 100A,100B,100C,100D. It is also to be noted at this juncture that all of the metering pumps or segments 100A, 100B,100C,100D are substantially identical with respect to each other from a structural point of view, although they may differ from each other from a volumetric value or rating point of view, whereby the metered fluid output volumes of the various metering pumps or segments 100A,100B,100C,100D may be different, and the significance of this feature, as well as the provision of the dowel pins 214,216 and the blind bores 218,220,222,224, upon each one of the metering pumps or segments 100A,100B, 100C,100D, particularly when the plurality of metering pumps or segments 100A,100B,100C, 100D are utilized to form the metering pump assembly 300, will be disclosed and described hereinafter.

Figure 3:
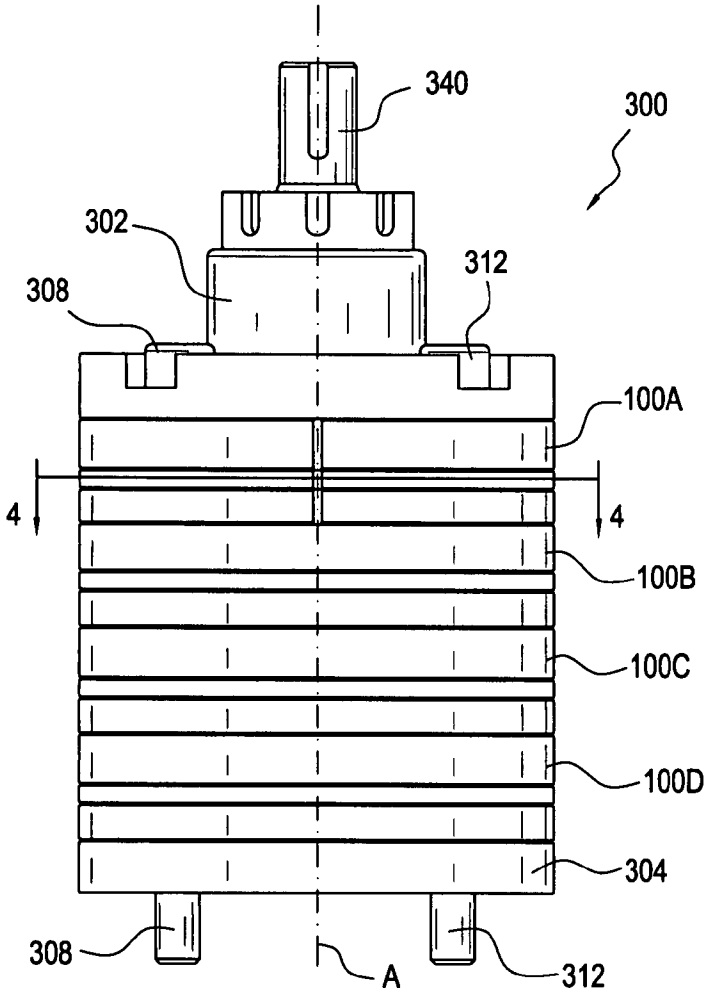
FIG. 3 is a front elevational view of the assembled metering pump assembly disclosed within FIG. 2.

With reference continuing to be made to FIG. 2, as well as reference being made to FIG. 3, and in connection with the formation of the metering pump assembly 300 from the plurality of vertically stacked and nested metering pumps or segments 100A,100B,100C,100D, it is further seen that the metering pump assembly 300, in addition to comprising the plurality of vertically stacked and nested metering pumps or segments 100A,100B,100C,100D, also comprises an upper pump seal assembly 302 and a lower pump adaptor plate 304. In addition, a plurality of cap screws, such as, for example, four (4) cap screws 306,308,310,312, are adapted to be used to fixedly secure the upper pump seal assembly 302, the four metering pumps or segments 100A,100B,100C,100D, and the lower pump adaptor plate 304 together. More particularly, it is seen that the flanged disk or plate portion of the upper pump seal assembly 302 is provided with four circumferentially spaced, equiangularly separated counterbored through-bores, only three of which are shown or visible at 314,316, 318, so as to permit the relatively small diameter shank portions of the cap screws 306,308,310,312 to pass therethrough while the relatively large diameter head portions of the cap screws 306,308,310,312 are seated upon shelf portions formed by the counterbored sections of the through-bores 314,316,318 formed within the flanged disk or plate portion of the upper pump seal assembly 302.

Correspondingly, with reference reverting back to FIG. 1, it is seen that the upper or top cap plate 102 of each metering pump or segment 100 is provided with correspondingly arranged through-bores 226,228,230,232, the intermediate or central pump plate 104 of each metering pump or segment 100 is provided with correspondingly arranged through-bores 234,236,238,240, and the lower or bottom base plate 106 of each metering pump or segment 100 is likewise provided with correspondingly arranged through-bores 242, 244,246,248. Lastly, the lower pump adaptor plate 304 of the metering pump assembly 300 is likewise provided with correspondingly arranged through-bores 320,322,324,326 which are adapted to permit the externally threaded lower end portions of the cap screws 306,308,310,312 to pass therethrough, as can best be seen in FIG. 3 with respect to cap screws 308, 312 such that the entire metering pump assembly 300 will not only be assembled together, as illustrated within FIG. 3, but in addition, can be fixedly mounted upon a suitable support component or surface as a result of the threaded engagement of the externally threaded lower end portions of the cap screws 306,308,310,312 within internally threaded bores provided within the support component. Alternatively, if the metering pump assembly 300 is to comprise a stand-alone pump assembly, then the bores 320,322,324,326 defined within the lower pump adaptor plate 304 would not be through-bores but would be internally threaded blind bores in which the lower end portions of the cap screws 306,308,310, 312 would be threadedly engaged. It is also noted that the upper surface portion of the lower pump adaptor plate 304 of the metering pump assembly 300 is provided with a plurality of blind bores, such as, for example, four (4) blind bores 328,330, 332,334, similar to the plurality of blind bores 218, 220, 222,224 provided within each upper or top cap plate 102 of each metering pump or segment 100, so as to accommodate the dowel pins 214,216 which project or extend downwardly from the lowermost metering pump or segment 100D of the metering pump assembly 300.

With reference reverting back to FIG. 2, it is seen that in connection with the metering pump assembly 300, a drive shaft assembly 336 is adapted to be coaxially inserted through each one of the metering pumps or segments 100A, 100B, 100C,100D such that the lower end portion 338 of the drive shaft assembly 336 is supported upon an axially central portion of the pump adaptor plate 304 while the upper end portion 340 of the drive shaft assembly projects upwardly and outwardly from the metering pump assembly 300, as can best be seen in FIG. 3, whereby a suitable rotatable drive force, indicated by the arrow CW denoting the drive in the clockwise direction, generated by means of a suitable drive motor, not shown, can be imparted to the drive shaft assembly 336. In order to accommodate the axially located drive shaft assembly 336, it is further seen, with reference reverting back to FIG. 1, that in addition to the pump plate 104 of each metering pump or segment 100 being provided with its central or axially located through-bore or cavity 212, the upper or top cap plate 102 of each metering pump or segment 100 is similarly provided with a central or axially located through-bore or cavity 250 while, still further, the lower or bottom base plate 106 of each metering pump or segment 100 is likewise provided with a central or axially located through-bore or cavity 252.

Figure 4:
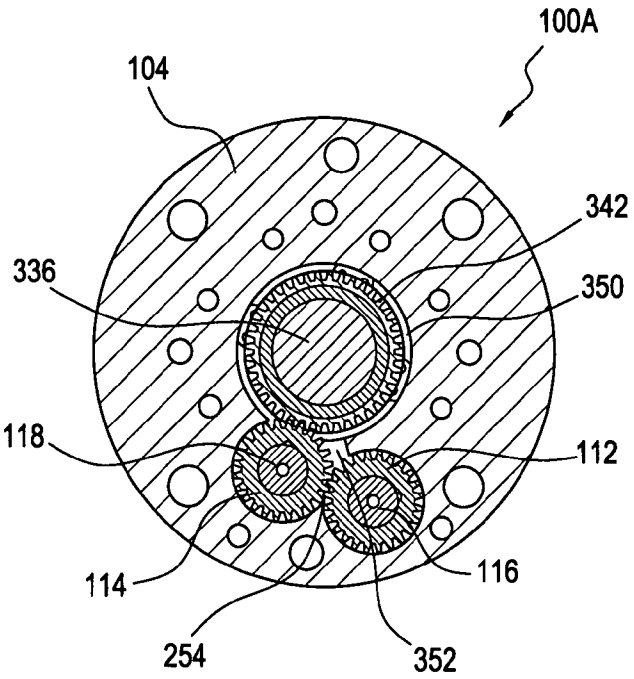
FIG. 4 is a cross-sectional view of the assembled metering pump assembly as disclosed within FIG. 3 and as taken along lines 4-4 of FIG. 3.

With reference again being made to FIG. 2, it is further seen that the drive shaft assembly 336 has a plurality of drive gears, such as, for example, four (4) drive gears 342,344,346,348 fixedly mounted thereon which are adapted to respectively drivingly engage the pump gear 114 of each metering pump or segment 100A,100B,100C,100D as can best be seen in FIG. 4 which is a cross-sectional view of the metering pump assembly 300 as taken along the lines 4-4 of FIG. 3. Accordingly, due to the clockwise rotation of the drive shaft assembly 336, the pump gear 114 of each metering pump or segment 100A,100B,100C,100D will undergo counterclockwise rotation, and the pump gear 112 of each metering pump or segment 100A,100B,100C,100D will undergo clockwise rotation. As the fluid to be pumped, which may be, for example, hot melt adhesive or some other thermoplastic material, enters the metering pump assembly 300 in a coaxial manner, with respect to the various metering pumps or segments 100A, 100B,100C,100D, as well as with respect to the drive shaft assembly 336, and along the flow path referenced by means of the arrow FIS in FIG. 2 denoting the same as the fluid inlet supply, it is noted that all of the central through-bores or cavities 252,212, and 250 respectively defined within the lower or bottom base plate 106, the intermediate or central pump plate 104, and the upper or top cap plate 102 will have inner diametrical extents which are slightly larger than the outer diametrical extents of the drive gears 342,344,346,348. Accordingly, the fluid will fill an annular area 350 which is defined between the external peripheral region of the drive gear 342 of the drive shaft assembly 336 and the internal peripheral wall portion of the pump plate 104 of the metering pump or segment 100A which defines the central cavity 212. This annular region 350 will exist within each metering pump or segment 100A,100B,100C,100D and therefore serves as a common fluid passageway or column by means of which the fluid, being supplied to the metering pump assembly 300 along the fluid inlet supply path FIS, can be supplied to each one of the metering pumps or segments 100A,100B,100C, 100D.

In addition, within each metering pump or segment 100A, 100B,100C,100D, and more particularly within each pump plate 104 of each metering pump or segment 100A,100B, 100C, 100D, a fluid region 352 is effectively defined at the juncture of pump gears 112,114 and drive gear 342 as shown in FIG. 4. The fluid supplied to the annular region 350 will therefore effectively be transmitted to, or will supply fluid for, pump gear 114, while the fluid within the fluid region 352 is effectively transmitted to, or will supply fluid for, pump gear 112. In order to in fact permit the fluid inlet supply FIS to enter the metering pump assembly 300 and to flow upwardly through the drive shaft assembly 336 as just previously described, the pump adaptor plate 304 of the metering pump assembly 300 is provided with a plurality of inlet ports, such as, for example, three circumferentially spaced inlet ports 354 as can best be seen in FIG. 2, a central region 355 of the pump adaptor plate 304 being used to support the lower end portion of the drive shaft assembly 336. Continuing further with reference still being made to FIG. 4, as the fluid effectively enters gear space defined within the pump plate 104 of the metering pump or segment 100A, the fluid will effectively fill the area defined between each gear tooth of the pump gears 112,114 and is carried within the cavities 108,110 so as to effectively be introduced into the gear meshing area 254 effectively defined within the pump plate 104 of the metering pump or segment 100A.

It is to be further appreciated that the gear meshing area 254, defined within the pump plate 104 of the metering pump or segment 100A, is fluidically connected to an outlet port 256 which is defined within the base plate 106 of each one of the metering pumps or segments 100A, 100B,100C, 100D as illustrated within FIG. 1 in connection with one of the metering pumps or segments 100. Still yet further, it is also seen, as can best be appreciated from FIG. 1, that the upper or top cap plate 102 of each metering pump or segment 100 is provided with a plurality of through-bores or fluid passageways, such as, for example, four through-bores or fluid passageways 258,260,262,264, which are arranged within a circumferentially or angularly spaced array near or adjacent to the inner periphery of the upper or top cap plate 102 such that the through-bores or fluid passageways 258,260,262,264 are effectively disposed within quadrant regions of the upper or top cap plate 102.

In turn, the intermediate or central pump plate 104 of each metering pump or segment 100 is provided with a plurality of through-bores or fluid passageways, such as, for example, three through-bores or fluid passageways 266,268,270 arranged in a manner similar to that of the through-bores or fluid passageways 258,260,262,264 defined within the upper or top cap plate 102 wherein the through-bores or fluid passageways 266,268,270 of the intermediate or central pump plate 104 are adapted to be coaxially aligned with the through-bores or fluid passageways 258,260,262 of the upper or top cap plate 102 while the fluid passageway 352 of the intermediate or central pump plate 104 is coaxially aligned with the through-bore or fluid passageway 264 of the upper or top cap plate 102. It is lastly noted that the lower or bottom base plate 106 is similarly provided with a plurality of through-bores or fluid passageways, such as, for example, three through-bores or fluid passageways 272,274,276, which are arranged in a manner similar to that of the through-bores or fluid passageways 258,260,262,264 defined within the upper or top cap plate 102, as well as with respect to the through-bores or fluid passageways 266,268,270 defined within the intermediate or central pump plate 104 wherein the through-bores or fluid passageways 272,274,276 of the lower or bottom base plate 106 are coaxially aligned with the through-bores or fluid passageways 266,268,270 defined within the intermediate or central pump plate 104 while the output port 256 of the lower or bottom base plate 106 is coaxially aligned with the fluid passageway 352 of the intermediate or central pump plate 104 as well as with the through-bore or fluid passageway 264 of the upper or top cap plate 102.

Lastly, with respect to the overall metering pump assembly 300, it is noted that the pump adaptor plate 304 of the metering pump assembly 300, in a manner similar to that of the upper or top cap plate 102 of a particular metering pump or segment 100, is provided with a plurality of through-bores or fluid passageways, such as, for example, four through-bores or fluid passageways 356,358,360,362, which are arranged within a circumferentially or angularly spaced quadrant array. In this manner, they are adapted to be coaxially aligned with respect to the various aforenoted through-bores or fluid passageways provided within the upper or top cap plates 102 of the metering pumps or segments 100A,100B,100C, 100D, and are likewise adapted to be coaxially aligned with respect to the various aforenoted through-bores or fluid passageways provided within the intermediate or central pump plates 104 of the metering pumps or segments 100A,100B,100C, 100D. In addition, they are also adapted to be coaxially aligned with respect to the various aforenoted through-bores or fluid passageways provided within the lower or bottom base plates 106 of the metering pumps or segments 100A,100B,100C, 100D. These through-bores or fluid passageways 356,358,360, 362 formed within the pump adaptor plate 304 of the metering pump assembly 300 serve as ultimate output ports from the metering pump assembly 300 wherein the particular volumetrically metered fluid outputs from such output ports can then be routed wherever desired to downstream output devices or to end use positions or locations. The significance of the aforenoted through-bores or fluid passageway quadrant arrangements, and the resulting fluid outputs from the ultimate output ports 356,358,360,362 defined within the pump adaptor plate 304 of the metering pump assembly 300, will now be disclosed and described.

It will be recalled that the plurality of metering pumps or segments 100A,100B,100C,100D are all substantially identical with respect to each other from a structural point of view. Accordingly, with reference being made to FIG. 2, while the metering pump assembly 300 is seen to comprise the vertical stack of metering pumps or segments 100A,100B,100C, 100D, the individual metering pumps or segments may be substituted for one another with no difference in the resulting fluid outputs through output ports 356,358,360,362 if all of the metering pumps or segments 100A,100B,100C,100D have the same metered flow output volumes, values, or ratings, or alternatively, if the metering pumps or segments 100A,100B, 100C,100D have different metered flow output volumes, ratings, or values, different fluid output volumes may be provided to predetermined ones of the ultimate fluid output ports 356,358,360,362. Therefore, a particular metering pump assembly 300 may alternatively comprise a vertical stack of metering pumps or segments 100A,100C,100B, 100D, a vertical stack of metering pumps or segments 100A, 100D,100B,100C, a vertical stack of metering pumps or segments 100A,100C,100D, 100B, or any one of other similar arrangements so as to provide predetermined volumetric outputs to predetermined ones of the ultimate fluid output ports 356,358,360,362. Furthermore, in the case of the illustrated metering pump assembly 300, the various fluid output flows routed to the ultimate fluid output ports 356,358,360,362 defined within the pump adaptor plate 304 of the metering pump assembly 300 will now be described.

After the fluid input enters the metering pump assembly 300 along the axial inlet flow path FIS, and through the inlet ports 354 of the pump adaptor plate 304, the fluid will be distributed to the various intermediate or central pump plates 104 of the four metering pumps or segments 100A, 100B, 100C,100D by means of the aforenoted common fluid passageway or column 350. Once the fluid has reached a particular intermediate or central pump plate 104 of a particular metering pump or segment 100A,100B,100C,100D, the fluid to be metered and pumped by means of that particular metering pump or segment 100A,100B,100C,100D will be discharged out through the outlet port 256 which is defined within the base plate 106 of that particular one of the metering pumps or segments 100A,100B,100C,100D. As an example, if the metering pump or segment 100D has been mounted within the metering pump assembly 300 such that the outlet port 256 of the base plate 106 of the metering pump segment 100D as illustrated within FIG. 2 is angularly disposed at a particular angular position with respect to the longitudinal axis of the entire metering pump assembly 300, which is coaxial with the longitudinal axes A of all of the metering pumps or segments 100A,100B,100C, 100D, as well as being coaxial with the fluid inlet supply flow path FIS, whereby the outlet port 256 of the base plate 106 of the metering pump segment 100D will be coaxially aligned with the ultimate fluid output port 362, which is defined within the upper right quadrant of the pump adaptor plate 304 of the metering pump assembly 300 as viewed in FIG. 2, then the fluid output 364 from metering pump or segment 100D will be outputted through means of ultimate fluid output port 362.

In a similar manner, if the metering pump or segment 100C has been mounted within the metering pump assembly 300 such that the outlet port 256 of the base plate 106 of the metering pump segment 100C as illustrated within FIG. 2 is angularly disposed at a particular angular position with respect to the longitudinal axis of the entire metering pump assembly 300 such that the angular position of the output port 256 of the base plate 106 of the metering pump or segment 100C is offset 90° in the counterclockwise direction from the angular position of the outlet port 256 of the base plate 106 of the metering pump or segment 100D, then the outlet port 256 of the base plate 106 of the metering pump segment 100C will be coaxially aligned with the ultimate fluid output port 356 defined within the upper left quadrant of the pump adaptor plate 304 of the metering pump assembly 300 as viewed in FIG. 2. Accordingly, the fluid output from the outlet port 256 of the lower or bottom base plate 106 of the metering pump or segment 100C will flow downwardly through the through-bore or fluid passageway 258 defined within the upper or top cap plate 102 of the metering pump or segment 100D, downwardly through the through-bore or fluid passageway 266 defined within the intermediate or central pump plate 104 of the metering pump or segment 100D, downwardly through the through-bore or fluid passageway 272 defined within the lower or bottom base plate 106 of the metering pump or segment 100D, and will finally be outputted as fluid output flow 366 through means of ultimate fluid output port 356.

Continuing further, and in a similar manner, if the metering pump or segment 100B has been mounted within the metering pump assembly 300 such that outlet port 256 of the base plate 106 of the metering pump segment 100B as illustrated within FIG. 2 is angularly disposed at a particular angular position with respect to the longitudinal axis of the entire metering pump assembly 300 whereby the angular position of the output port 256 of the base plate 106 of the metering pump or segment 100B is offset 90° in the counterclockwise direction from the angular position of the outlet port 256 of the base plate 106 of the metering pump or segment 100C, then the outlet port 256 of the base plate 106 of the metering pump segment 100B will be coaxially aligned with the ultimate fluid output port 358 which is defined within the lower left quadrant of the pump adaptor plate 304 of the metering pump assembly 300 as viewed in FIG. 2. Accordingly, the fluid output from the outlet port 256 of the lower or bottom base plate 106 of the metering pump or segment 100B will flow downwardly through the through-bore or fluid passageway 260 defined within the upper or top cap plate 102 of the metering pump or segment 100C, downwardly through the through-bore or fluid passageway 268 defined within the intermediate or central pump plate 104 of the metering pump or segment 100C, and downwardly through the through-bore or fluid passageway 274 defined within the lower or bottom base plate 106 of the metering pump or segment 100C. Yet further, the fluid flow will be conducted downwardly through the through-bore or fluid passageway 260 defined within the upper or top cap plate 102 of the metering pump or segment 100D, downwardly through the through-bore or fluid passageway 268 defined within the intermediate or central pump plate 104 of the metering pump or segment 100D, downwardly through the through-bore or fluid passageway 274 defined within the lower or bottom base plate 106 of the metering pump or segment 100D, and will be finally outputted through means of ultimate fluid output port 358.

Lastly, it will be appreciated that if the metering pump or segment 100A has been mounted within the metering pump assembly 300 such that outlet port 256 of the base plate 106 of the metering pump segment 100A, as illustrated within FIG. 2, is angularly disposed at a particular angular position with respect to the longitudinal axis of the entire metering pump assembly 300, whereby the angular position of the output port 256 of the base plate 106 of the metering pump or segment 100A is offset 90° in the counterclockwise direction from the angular position of the outlet port 256 of the base plate 106 of the metering pump or segment 100B, then the outlet port 256 of the base plate 106 of the metering pump segment 100A will be coaxially aligned with the ultimate fluid output port 360 which is defined within the lower right quadrant of the pump adaptor plate 304 of the metering pump assembly 300. Accordingly, the fluid output from the outlet port 256 of the lower or bottom base plate 106 of the metering pump or segment 100A will flow downwardly through the through-bore or fluid passageway 262 defined within the upper or top cap plate 102 of the metering pump or segment 100B, downwardly through the through-bore or fluid passageway 270 defined within the intermediate or central pump plate 104 of the metering pump or segment 100B, and downwardly through the through-bore or fluid passageway 276 defined within the lower or bottom base plate 106 of the metering pump or segment 100B such that the fluid flow can then effectively enter the metering pump or segment 100C. Accordingly, the fluid flow will be conducted downwardly through the through-bore or fluid passageway 262 de-fined within the upper or top cap plate 102 of the metering pump or segment 100C, downwardly through the through-bore or fluid passageway 270 defined within the intermediate or central pump plate 104 of the metering pump or segment 100C, and downwardly through the through-bore or fluid passageway 276 defined within the lower or bottom base plate 106 of the metering pump or segment 100C. Lastly, the fluid output will be conducted downwardly through the through-bore or fluid passageway 262 defined within the upper or top cap plate 102 of the metering pump or segment 100D, downwardly through the through-bore or fluid passageway 270 defined within the intermediate or central pump plate 104 of the metering pump or segment 100D, and downwardly through the through-bore or fluid passageway 276 defined within the lower or bottom base plate 106 of the metering pump or segment 100D so as to be finally outputted as a fluid flow 370 through means of ultimate fluid output port 360.

In view of the aforenoted substantially identicality of the various metering pumps or segments 100A,100B,100C, 100D with respect to a structural point of view, it is to be appreciated that not only can the various metering pumps or segments 100A,100B,100C,100D be mounted in accordance with a predetermined order defined within the assembled stack of metering pumps or segments so as to define the assembled pump assembly 300, that is, the various metering pumps or segments can be mounted in the arranged illustrated order ABCD, or alternatively, ACBD, ADBC, ADCB, or the like, but, in addition, the angular position of the various metering pumps or segments 100A,100B, 100C,100D within the stacked array comprising the assembled metering pump assembly 300 can also be altered. This is a significant feature of the metering pumps or segments 100A,100B,100C,100D, as well as for the overall metering pump assembly 300 of the present invention.

In other words, in lieu of the illustrated angular order wherein metering pump or segment 100A discharges its metered flow output volume 370 through means of a first ultimate output port 360 disposed in what may be considered a first or lower right quadrant, metering pump or segment 100B discharges its metered flow output volume 368 through means of a second ultimate output port 358 which is located in what may be considered a second or lower left quadrant, metering pump or segment 100C discharges its metered flow output volume 366 through means of a third ultimate output port 356 which is located in what may be considered a third or upper left quadrant, and metering pump or segment 100D discharges its metered flow output volume 364 through means of a fourth ultimate output port 362 which is located what may be considered to be a fourth or upper right quadrant, the various metering pumps or segments 100A,100B,100C, 100D can be angularly positioned in alternative modes such that the various metering pumps or segments 100A,100B, 100C,100D can have their metered flow output volumes 364, 366,368,370 discharged through any one of the predetermined ultimate output ports 356,358, 360,362 which may differ from the illustrated example. Accordingly, different end uses may dictate or require different metered flow output volumes whereby a particular one of the metering pumps or segments 100A,100B,100C,100D may be fluidically connected to a particular one of the ultimate output ports 356, 358,360,362 so as to provide the desired or required metered flow output volumes 364,366,368,370.

Continuing along these lines, it is to be appreciated that by mounting the different metering pumps or segments at predetermined angular positions, other than those specifically illustrated within FIG. 2, we may achieve different fluid output volumes as desired or required. For example, if metering pump or segment 100C was to be angularly rotated from its angular disposition illustrated within FIG. 2 to a different angular disposition such that its metered output flow volume 366 would be coaxially aligned with ultimate output port 362 in lieu of being coaxially aligned with ultimate output port 356, the metered flow output volume of the outputs from metering pumps or segments 100D and 100C would effectively be added together. For example, if metering pumps or segments 100C,100D both comprise pumps which are rated or valued as one cubic centimeter (1 cc) pumps, meaning that each pump outputs one cubic centimeter (1 cc) of fluid per revolution, then normally the metered flow output volume 364 from metering pump or segment 100D, outputted through means of ultimate output port 362, would be one cubic centimeter (1 cc) per revolution of the metering pump or segment 100D, and similarly for metering pump or segment 100C. However, if the metering pump or segment 100C is angularly positioned within the metering pump assembly 300 such that its metered flow output volume 366 is coaxially aligned with the fluid output 364 of metering pump or segment 100D such that the resulting metered flow output volume will be outputted through means of ultimate output port 362, then the resulting metered flow output volume outputted through ultimate output port 362 will be two cubic centimeters (2 ccs). It is therefore readily apparent that different fluid output volumes can be readily achieved at the different ultimate output ports 356,358,360,362 located within the aforenoted quadrants by selectively programming or arranging the metering pumps or segments 100A,100B,100C,100D within the overall metering pump assembly 300 as has been described. It is also to be readily appreciated that the different metering pumps or segments 100A,100B,100C,100D may differ in size, that is, their metered flow output volume ratings. For example, while metering pumps or segments 100A,100C may be one cubic centimeter (1 cc) pumps, metering pumps or segments 100B, 100D may be two cubic centimeter (2 cc) pumps. Accordingly, different metered flow output volumes may be achieved at the different ultimate output ports 356,358,360,362 depending upon which metering pump or segment 100A, 100B,100C,100D is operatively associated with the particular ultimate output port 356,358,360,362, or alternatively, the fluid outputs of one or more of the metering pumps or segments may be combined as has been described hereinbefore so as to achieve still additional variations in the fluid volumes which are able to be outputted to predetermined ones of the ultimate output ports 356,358,260,362.

Still yet further, a particular one of the metering pumps or segments 100A,100B,100C,100D, having, for example, a particular metered flow output volume rating, may be interchanged with another one of the metering pumps or segments 100A,100B,100C,100D, having, for example, a particular but different metered flow output volume rating, and effectively maintained at the same angular position within the overall metering pump assembly 300, such that the metered flow output volume discharged from a particular one of the ultimate output ports 356,358,360,362 is changed or altered as may be desired or required by means of a particularly desired end use. Lastly, one of the metering pumps or segments 100A, 100B,100C,100D may be removed from the metering pump assembly 300 and an entirely new metering pump or segment, similar in structure to the existing metering pumps or segments 100A,100B,100C,100D, but having, for example, a different metered flow output volume rating, may be exchanged for the removed metering pump or segment such that the metered flow output volume discharged from a particular one of the ultimate output ports 356,358,360,362 is changed or altered as may also be desired or required by means of a particularly desired end use.

Thus, it may be seen that in accordance with the principles and teachings of the present invention, there has been disclosed a new and improved metering pump or segment, and a new and improved metering pump assembly comprising a plurality of the metering pumps or segments, wherein in connection with the individual metering pumps or segments, the drive shaft assembly for driving the pump gears of each metering pump or segment is coaxially aligned with the longitudinal axis of the pump or segment, as is the fluid inlet supply path, whereby only three gears are required to comprise each metering pump or segment. In connection with the metering pump assembly comprising the plurality of metering pumps or segments, not only is the drive shaft assembly and fluid inlet supply path coaxial with the longitudinal axis of the metering pump assembly, but the single drive shaft assembly is utilized to drive all of the metering pumps or segments comprising the metering pump assembly, and the different metering pumps or segments are fluidically connected together by means of a common fluid passageway. In addition, the different metering pumps or segments comprising the metering assembly can be interchanged with respect to each other so as to permit different metered fluid output volumes to be outputted at different predetermined locations. Furthermore, different metering pumps or segments, having different output ratings or values, can be exchanged for existing metering pumps or segments within the metering pump assembly and thereby disposed at the predetermined positions within the metering pump assembly so as to achieve the different metered flow output volumes at the predetermined positions. Lastly, different metering pumps or segments can be disposed or arranged such that their fluid output flows will be located at substantially the same predetermined positions within the metering pump assembly whereby the metered fluid output volumes from the various metering pumps or segments can effectively be added together so as to achieve additionally desired metered fluid output volumes which are different from that achieved from any single one metering pump or segment.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A metering pump or segment, comprising:

a pump plate defined around an axis and having a central cavity defined therein;

a drive shaft assembly disposed coaxially with respect to said axis of said pump plate, extending through said central cavity defined within said pump plate, and having a drive gear mounted upon said drive shaft assembly so as to be disposed within said pump plate;

at least one pump gear disposed within said pump plate and engaged with said drive gear so as to be driven by said drive gear;

a fluid inlet supply path disposed coaxially with respect to said drive shaft assembly and said pump plate for supplying a fluid into said metering pump along an annular flow path circumferentially surrounding, and in contact with, said drive gear mounted upon said drive shaft and an external peripheral portion of said drive shaft; and a metered output fluid flow from said metering pump.

2. The metering pump as set forth in claim 1, wherein:

said at least one pump gear comprises a pair of pump gears wherein a first one of said pair of pump gears is meshingly engaged with said drive gear of said drive shaft assembly, and a second one of said pair of pump gears is meshingly engaged with said first one of said pair of pump gears so as to pump the metered amount of fluid out from said metering pump.

3. The metering pump as set forth in claim 2, wherein:

said metering pump comprises a sandwich construction comprising an upper cap plate, a lower base plate, and said pump plate interposed between said upper cap plate and said lower base plate and having a pair of cavities defined therein for accommodating said pair of pump gears.

4. The metering pump as set forth in claim 3, further wherein:

each one of said pair of pump gears has an annular configuration with central openings defined therein; and a pair of idler pins are respectively disposed within said central openings of said pair of pump gears, with opposite end portions of said pair of idler pins respectively disposed within bores defined within said upper cap plate and said lower base plate, so as to maintain said pair of pump gears centrally located within said pair of cavities defined within said pump plate.

5. The metering pump as set forth in claim 4, further comprising:

a pair of dowel pins disposed through said upper cap plate, said lower base plate, and said pump plate interposed between said upper cap plate and said lower base plate for properly angularly aligning said upper cap plate, said lower base plate, and said pump plate, interposed between said upper cap plate and said lower base plate, with respect to each other so as to permit said pair of idler pins to be properly seated within said upper cap plate and said lower base plate.

6. The metering pump as set forth in claim 3, further comprising:

a plurality of fasteners disposed through said upper cap plate, said pump plate interposed between said upper cap plate and said lower base plate, and said lower base plate, for fixedly securing said upper cap plate, said pump plate inter-posed between said upper cap plate and said lower base plate, and said lower base plate together so as to define said sandwich construction of said metering pump.

7. The metering pump as set forth in claim 6, wherein:

said plurality of fasteners are disposed within a substantially horse-shoe shaped array so as to surround said central cavity defined within said pump plate for accommodating said drive gear and said drive shaft assembly, and said pair of cavities for accommodating said pair of pump gears, so as to ensure surface-to-surface contact between said pump plate and said upper cap plate, and between said pump plate and said lower base plate, in order to assuredly prevent leakage of fluid out from said metering pump.

8. A metering pump or segment as set forth in claim 1, wherein:

said metering pump or segment is adapted to be utilized with a plurality of similar metering pumps or segments wherein said fluid inlet supply path, disposed coaxially with respect to said drive shaft assembly, supplies fluid into each one of said plurality of similar metering pumps or segments along said annular flow path circumferentially surrounding said external peripheral portion of said drive shaft such that a metered amount of fluid is metered as an output fluid flow from each one of said plurality of similar metering pumps or segments.

9. A metering pump assembly, comprising:

a plurality of metering pumps disposed within a serial array wherein each one of said plurality of metering pumps is disposed coaxially around a common longitudinal axis of said metering pump assembly and wherein each one of said plurality of metering pumps comprises at least one pump gear;

a drive shaft assembly disposed coaxially with respect to said common longitudinal axis of said plurality of metering pumps, wherein said drive shaft assembly has a plurality of drive gears mounted thereon for respective engagement with said at least one pump gear of each one of said plurality of metering pumps so as to drive said at least one pump gear of each one of said plurality of metering pumps;

a fluid inlet supply port disposed coaxially with respect to said drive shaft assembly and said common longitudinal axis of said plurality of metering pumps for supplying a fluid into said metering pump assembly along an annular flow path circumferentially surrounding and in contact with, said drive gear mounted upon said drive shaft and an external peripheral portion of said drive shaft assembly whereby the fluid is supplied to each one of said plurality of metering pumps; and a metered output fluid flow from each one of said plurality of metering pumps of said metering pump assembly.

10. The metering pump assembly as set forth in claim 8, wherein:

a common fluid inlet supply passageway is defined internally within said metering pump assembly such that incoming fluid is distributed from said fluid inlet supply port to each one of said plurality of metering pumps comprising said metering pump assembly.

11. The metering pump assembly as set forth in claim 8, wherein:

said at least one pump gear disposed within each one of said plurality of metering pumps comprises a pair of pump gears wherein a first one of said pair of pump gears is meshingly engaged with a respective one of said plurality of drive gears disposed upon said drive shaft assembly, and a second one of said pair of pump gears is meshingly engaged with said first one of said pair of pump gears so as to pump the metered amount of fluid out from said metering pump.

12. The metering pump assembly as set forth in claim 10, wherein:

each one of said plurality of metering pumps comprises a sandwich construction comprising an upper cap plate, a lower base plate, and a pump plate interposed between said upper cap plate and said lower base plate and having a pair of cavities defined therein for accommodating said pair of pump gears.

13. The metering pump assembly as set forth in claim 11, further wherein:

each one of said pair of pump gears has an annular configuration with central openings defined therein; and a pair of idler pins are respectively disposed within said central openings of said pair of pump gears, with opposite end portions of said pair of idler pins respectively disposed within bores defined within said upper cap plate and said lower base plate, so as to maintain said pair of pump gears centrally located within said pair of cavities defined within said pump plate.

14. The metering pump assembly as set forth in claim 12, further comprising:

a first pair of dowel pins disposed through said upper cap plate, said lower base plate, and said pump plate interposed between said upper cap plate and said lower base plate for properly angularly aligning said upper cap plate, said lower base plate, and said pump plate, interposed between said upper cap plate and said lower base plate, with respect to each other so as to permit said pair of idler pins to be properly seated within said upper cap plate and said lower base plate.

15. The metering pump assembly as set forth in claim 11, further comprising:

a first set of fasteners disposed through said upper cap plate, said pump plate interposed between said upper cap plate and said lower base plate, and said lower base plate, for fixedly securing said upper cap plate, said pump plate interposed between said upper cap plate and said lower base plate, and said lower base plate together so as to define said sandwich construction of each one of said plurality of metering pumps.

16. The metering pump assembly as set forth in claim 14, wherein:

said first set of fasteners are disposed within a substantially horse-shoe shaped array so as to surround a central cavity defined within each one of said pump plates for accommodating said drive gear and said drive shaft assembly, and said pair of cavities for accommodating said pair of pump gears, so as to ensure surface-to-surface contact between said pump plate and said upper cap plate, and between said pump plate and said lower base plate, so as to assuredly seal said upper cap plate with respect to said pump plate, and said pump plate with respect to said lower base plate, in order to effectively prevent leakage of fluid out from any one of said plurality of metering pumps.

17. The metering pump assembly as set forth in claim 11, wherein:

said serial array of said plurality of metering pumps comprises a vertically stacked nested array of said plurality of metering pumps.

18. The metering pump assembly as set forth in claim 16, further comprising:

four bores respectively defined within equiangularly spaced quadrants defined within said upper cap plate of each one of said plurality of metering pumps; and a second pair of diametrically opposed dowel pins projecting downwardly from undersurface portions of each one of said lower base plates of each one of said plurality of metering pumps whereby when a first one of said plurality of metering pumps is disposed above a second one of said plurality of metering pumps disposed within said vertically stacked nested array of said plurality of metering pumps comprising said metering pump assembly, the angular orientation of said first one of said plurality of metering pumps, with respect to said second one of said plurality of metering pumps, disposed beneath said first one of said plurality of metering pumps within said vertically stacked nested array of said plurality of metering pumps comprising said metering pump assembly, and as considered with respect to said longitudinal axis of said metering pump assembly, will be determined as a result of within which two diametrically opposite bores, of said four bores defined within said upper cap plate of said second lower one of said plurality of metering pumps of said metering pump assembly, said second pair of dowel pins of said first upper one of said plurality of metering pumps of said metering pump assembly will be disposed, whereby said first one of said plurality of metering pumps may be angularly oriented with respect to said second one of said plurality of metering pumps in angular increments of 90°.

19. The metering pump assembly as set forth in claim 17, wherein:

said metering pump assembly comprises an upper pump seal assembly disposed atop the uppermost one of said plurality of metering pumps comprising said metering pump assembly, and a lower pump adaptor plate disposed beneath the lowermost one of said plurality of metering pumps comprising said metering pump assembly.

20. The metering pump assembly as set forth in claim 18, wherein:

a metered fluid output port is defined within each one of said pump plates of each one of said metering pumps;

a plurality of ultimate output ports are defined within quadrants of said lower pump adaptor plate; and vertically oriented fluid passages are defined within, and extend through, all of said plurality of metering pumps so as to permit the fluid output from any one of said metered fluid output ports of said plurality of metering pumps to be fluidically connected to any one of said plurality of ultimate output ports defined within said lower pump adaptor plate.

21. The metering pump assembly as set forth in claim 19, wherein:

multiple metering pumps of said metering pump assembly may be angularly oriented to the same predetermined angular positions with respect to said common longitudinal axis of said metering pump assembly such that the fluid outputs from said multiple metering pumps may be discharged through the same ultimate output port defined within a particular quadrant of said lower pump adaptor plate of said metering pump assembly whereby fluid volumes from different ones of said plurality of metering pumps may effectively be combined and discharged from predetermined ones of said ultimate mate output ports defined within said lower pump adaptor plate of said metering pump assembly.

22. The metering pump assembly as set forth in claim 18, further comprising:

a second set of fasteners disposed through said upper pump seal assembly, said plurality of metering pumps, and said lower pump adaptor plate so as to fixedly secure said upper pump seal assembly, said plurality of metering pumps, and said lower pump adaptor plate together and thereby define said metering pump assembly.

23. The metering pump assembly as set forth in claim 8, wherein:

different ones of said plurality of metering pumps, each one having different metered fluid output ratings, are removably disposed within said metering pump assembly.

* * * * *